US007516721B2

(12) United States Patent
Syler

(10) Patent No.: US 7,516,721 B2
(45) Date of Patent: Apr. 14, 2009

(54) FOAM DAM

(75) Inventor: Rodney Ray Syler, Franklin, TN (US)

(73) Assignee: AOS Holding Company, Wilmington, DE (US)

( * ) Notice: Subject to any disclaimer, the term of this patent is extended or adjusted under 35 U.S.C. 154(b) by 240 days.

(21) Appl. No.: 11/464,532

(22) Filed: Aug. 15, 2006

(65) Prior Publication Data

US 2008/0066308 A1 Mar. 20, 2008

(51) Int. Cl.
*F24H 9/02* (2006.01)

(52) U.S. Cl. ..... 122/19.2; 29/890.051

(58) Field of Classification Search ..... 122/19.2, 122/494; 29/890.03, 890.051; 220/567.3, 220/694.1; 392/441, 447, 448
See application file for complete search history.

(56) References Cited

U.S. PATENT DOCUMENTS 4,744,202 A 5/1988 Wylie
5,052,346 A 10/1991 Beck
5,163,119 A * 11/1992 Windon ..... 392/449
5,263,469 A 11/1993 Hickman
5,299,280 A * 3/1994 Ruark ..... 122/19.2
5,474,202 A 12/1995 Moore, Jr.
5,899,198 A 5/1999 Bradenbaugh
6,143,217 A 11/2000 Jackson et al.
6,658,204 B2 12/2003 Schurter et al.
6,885,816 B1 4/2005 Hicks et al.
6,898,375 B2 5/2005 Henderson et al.
6,917,756 B2 * 7/2005 Henderson et al. ..... 392/478

* cited by examiner

*Primary Examiner*—Gregory A Wilson
(74) *Attorney, Agent, or Firm*—Michael Best & Friedrich LLP

(57) ABSTRACT

A dam assembly to protect a component mounted on a water heater tank wall while insulating foam is injected between the tank and a jacket surrounding the tank, the dam assembly comprising an outer portion, an inner portion, and a frangible web connecting the inner and outer portions, the web having a strength sufficient to withstand force applied to the inner portion to press the dam assembly into an aperture in the jacket such that the outer portion surrounds the component between the tank and the jacket, and the web breaking under the application of a pre-determined force on the inner portion, allowing the inner portion to be at least partially pushed inside the outer portion to enclose the component within the dam assembly.

32 Claims, 4 Drawing Sheets

FOAM DAM

BACKGROUND

The present invention relates to water heaters.

SUMMARY

In one embodiment, the invention provides a dam assembly to protect a component mounted on a water heater tank wall while insulating foam is injected between the tank and a jacket surrounding the tank, the dam assembly comprising an outer portion, an inner portion, and a frangible web connecting the inner and outer portions, the web having a strength sufficient to withstand force applied to the inner portion to press the dam assembly into an aperture in the jacket such that the outer portion surrounds the component between the tank and the jacket, and the web breaking under the application of a pre-determined force on the inner portion, allowing the inner portion to be at least partially pushed inside the outer portion to enclose the component within the dam assembly.

In another embodiment the invention provides a water heater comprising a tank, means for heating water in the tank, a component mounted on the tank, a jacket substantially surrounding the tank and including an aperture providing access to the component, foam insulation between the tank and the jacket, a dam assembly including an inner portion, and outer portion, and a frangible web connecting the inner and outer portions, the web having a strength sufficient to withstand force applied to the inner portion to press the dam assembly into the aperture in the jacket such that the outer portion surrounds the component between the tank and the jacket, and the web breaking under the application of a pre-determined force on the inner portion, allowing the inner portion to be at least partially pushed inside the outer portion to enclose the component within the dam assembly.

In another embodiment the invention provides a method of manufacturing a water heater, the method comprising providing a water heater including a water tank, means for heating water in the water tank, a component mounted on the tank, and a jacket substantially surrounding the tank and including an aperture providing access to the component. The method further comprises providing a dam assembly including an inner portion, an outer portion, and a frangible web connecting the inner and outer portions. The method further comprises pressing on the inner portion to push the dam assembly into the aperture such that the outer portion surrounds the component between the tank and the jacket, thereafter pressing the inner portion of the dam assembly with sufficient force to break the web and at least partially push the inner portion into the outer portion to enclose the component within the dam assembly, and injecting foam insulation between the water tank and the jacket and outside the dam assembly.

Other aspects of the invention will become apparent by consideration of the detailed description and accompanying drawings.

DETAILED DESCRIPTION

Figure 1:
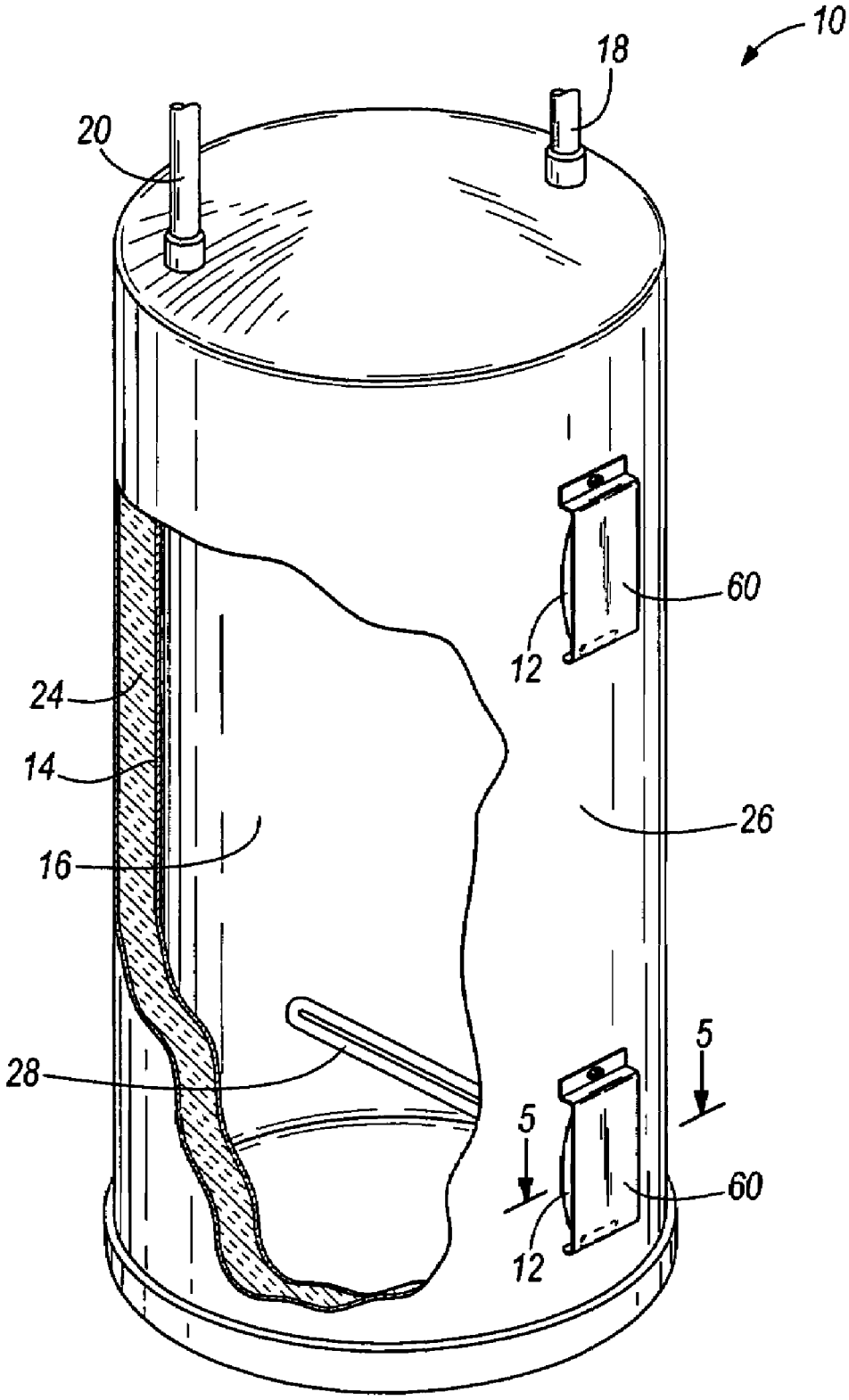
FIG. 1 is a perspective view of a water heater including a dam assembly embodying the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIGS. 1-6 illustrate a water heater 10 including a dam assembly 12 embodying the present invention. In the illustrated embodiment, the water heater 10 is an electric water heater. In some embodiments, the water heater 10 can be a gas water heater. The water heater 10 includes a substantially cylindrical tank 14 that defines a water chamber 16. A cold water inlet 18 and a hot water outlet 20 extend through the top of the tank 14. The tank 14 is substantially surrounded by foam insulation material 24 to reduce heat loss through the tank 14. A thin jacket 26 surrounds and protects the insulation material 24. The manner in which the insulation material 24 is placed between the tank 14 and the jacket 26 is described in greater detail below.

The water heater 10 includes two heating elements 28. In some embodiments, the water heater 10 can include one, three, or more heating elements 28. In the illustrated embodiment, the heating elements 28 are U-shaped tubes that conduct electricity to heat water in the tank 14. The heating elements 28 include a threaded portion at one end that permit the heating elements 28 to thread into spuds (not shown) which are connected to the wall of the tank 14. In the illustrated embodiment, a thermostat 34 is positioned on the wall of the tank 14 over each spud and communicates with the heating elements 28. In some embodiments, a single thermostat 34 can be used to communicate with both heating elements. The thermostats 34 monitor the temperature of the water in the tank 14, and turn the corresponding heating elements 28 on and off to maintain a desired water temperature in the tank 14. In the illustrated embodiment, the thermostats 34 permit an operator to adjust the desired water temperature. The thermostats 34 are accessible to an operator through apertures 36 defined by the jacket 26. In the illustrated embodiment, the apertures 36 are oval-shaped. In some embodiments, the apertures 36 can be round, square, rectangular, or any other desired shape.

In the illustrated embodiment, the insulation material 24 is injected between the tank 14 and the jacket 26, and expands to fill the volume between the tank 14 and the jacket 26. A dam assembly 12 is inserted into each of the apertures 36 prior to injecting the insulation material 24 to help prevent the foam from potentially damaging the thermostats 34 and escaping through the apertures 36.

As best shown in FIGS. 2-5, the dam assembly 12 includes an outer portion 38 and an inner portion 40. The outer portion 38 includes a wall 42 defining an oval-shaped perimeter, and a lip 44 extending outwardly from the top of the wall 42. The outer portion 38 also includes tabs 46 extending from the lip 44 at opposite ends of the outer portion 38. The tabs 46 are discussed in greater detail below. A resilient seal 45 is positioned on the inner surface of the wall 42. The wall 42 tapers from the outside or top of the wall 42 toward the inside or bottom of the wall 42 to ease insertion of the dam assembly 12 into the aperture 36 and to ease removal of the dam assembly 12 from a molding die during manufacturing. The inner portion 40 is oval shaped and is connected to the top surface of the outer portion 38 by a frangible web 48. The inner portion 40 includes a handle 50 and recesses 52, which are explained in greater detail below.

Figure 5:
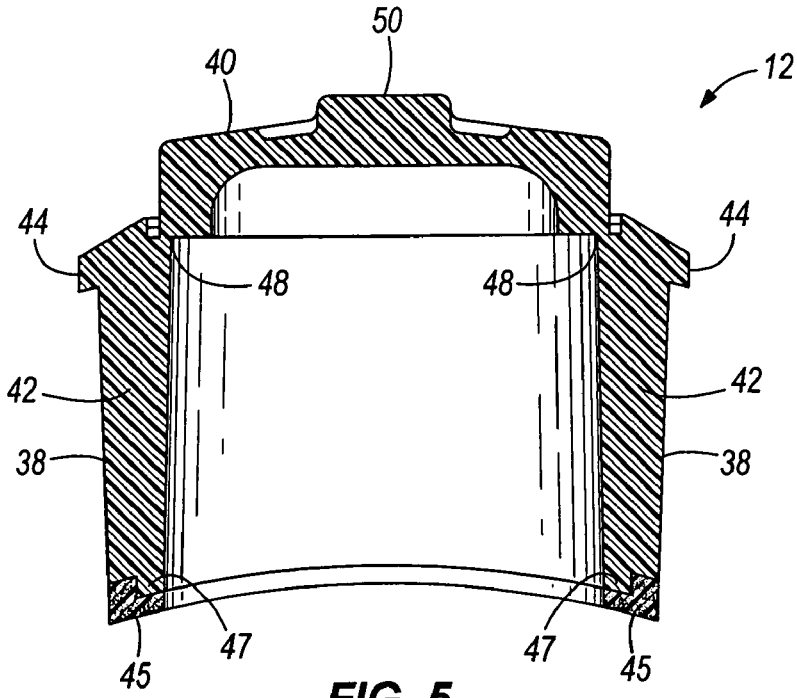
FIG. 5 is a cross-sectional view of an alternative dam assembly of FIG. 1 taken along line 4-4 in FIG. 3.

In the illustrated embodiment the outer portion 38, the inner portion 40, and the web 48 are constructed from expanded polystyrene foam, and are molded together as a single piece in a single operation. Unassembled dam assemblies 12 constructed in this manner can nest together, and are stackable for convenient storage. In some embodiments, either or both of the outer portion 38 and the inner portion 40 can be constructed from other materials such as, for example, polyethylene, polypropylene, or polyurethane, and are not necessarily molded as a single piece. In the illustrated embodiment, the seal 45 is constructed from open-cell polyurethane. In some embodiments, the seal 45 can be formed from other materials such as, for example, a hot melt adhesive that is flexible enough to form a seal around wires. In the illustrated embodiment, the seal 45 is applied to the bottom of the outer portion 38 with adhesive after the outer portion 38 and inner portion 40 are molded. As shown in FIG. 5, the seal 45 could also be stretched around a small flange 47 on the bottom of the outer portion 38 and held in place by elasticity rather than adhesive. In some embodiments, the seal 45 can be molded in a two-stage molding operation at the same time the outer portion 38 and inner portion 40 are molded. In such embodiments, the outer portion 38 and the inner portion 40 are molded separately from the seal 45, but in the same molding die such that the seal 45 is molded directly onto the outer portion 38, or the outer portion 38 is molded directly onto the seal 45.

Figure 6:
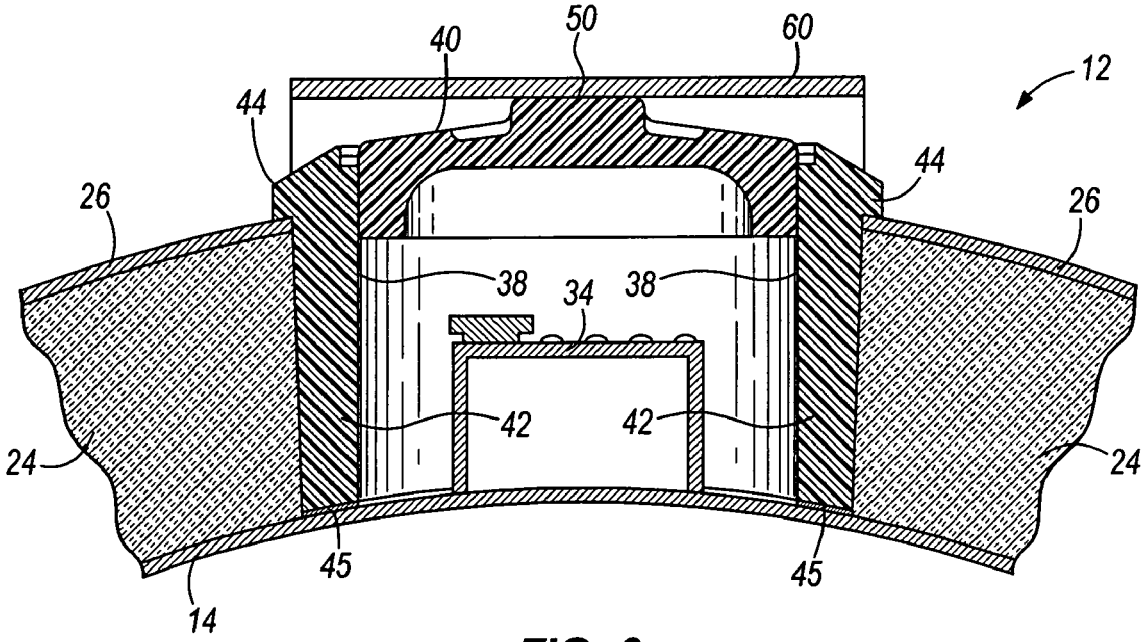
FIG. 6 is a cross-sectional view of the water heater and dam assembly of FIG. 1.

To install the dam assembly 12, an operator inserts the outer portion 38 in the aperture 36 and applies force to the inner portion 40. The force is transferred to the outer portion 38 through the web 48. As best shown in FIG. 6, when the outer portion 38 is installed in the aperture 36, the outer portion 38 surrounds the thermostat 34 between the tank 14 and the jacket 26, and the inner portion 40 substantially covers the thermostat 34. As the dam assembly 12 is inserted into the aperture 36, the tapered wall 42 of the outer portion 38 forms an interference fit with the jacket 26 about the aperture 36 and the seal 45 is compressed into sealing engagement with the tank 14. The interference fit between the wall 42 and the jacket 26 helps prevent the insulation material 24 from leaking through the aperture 36 around the outer portion 38, and the seal 45 helps prevent the insulation material 24 from leaking between the tank 14 and the outer portion 38 to protect the thermostat 34. The oval shape of the outer portion 38 also resists deformation during injection and expansion of the insulation material 24 because the convex shape of the wall 42 can withstand greater force than a flat or square wall of similar thickness.

The web 48 can withstand sufficient force applied to the inner portion 40 to seat the dam assembly 12 in the aperture 36. Application of additional force causes the web 48 to rupture and the inner portion 40 to be pressed inside the wall 42 of the outer portion 38. The inner portion 40 forms an interference fit with the wall 42 of the outer portion 38, and forces the wall 42 into tighter interference with the jacket 26, thereby improving the seal between the wall 42 and the jacket 26. After the web 48 breaks, the outer portion 38 remains installed in the aperture 36 in the jacket 26. The inner portion 40 is removable from the outer portion 38, but the inner portion 40 should remain inside the wall 42 of the outer portion 38 during injection and expansion of the insulation material 24 to ensure the best seal between the outer portion 38 and the jacket 26. An operator can grasp the handle 50 near the recesses 52 to remove of the inner portion 40 from the outer portion 38 and provide access to the thermostat 34.

Figure 2:
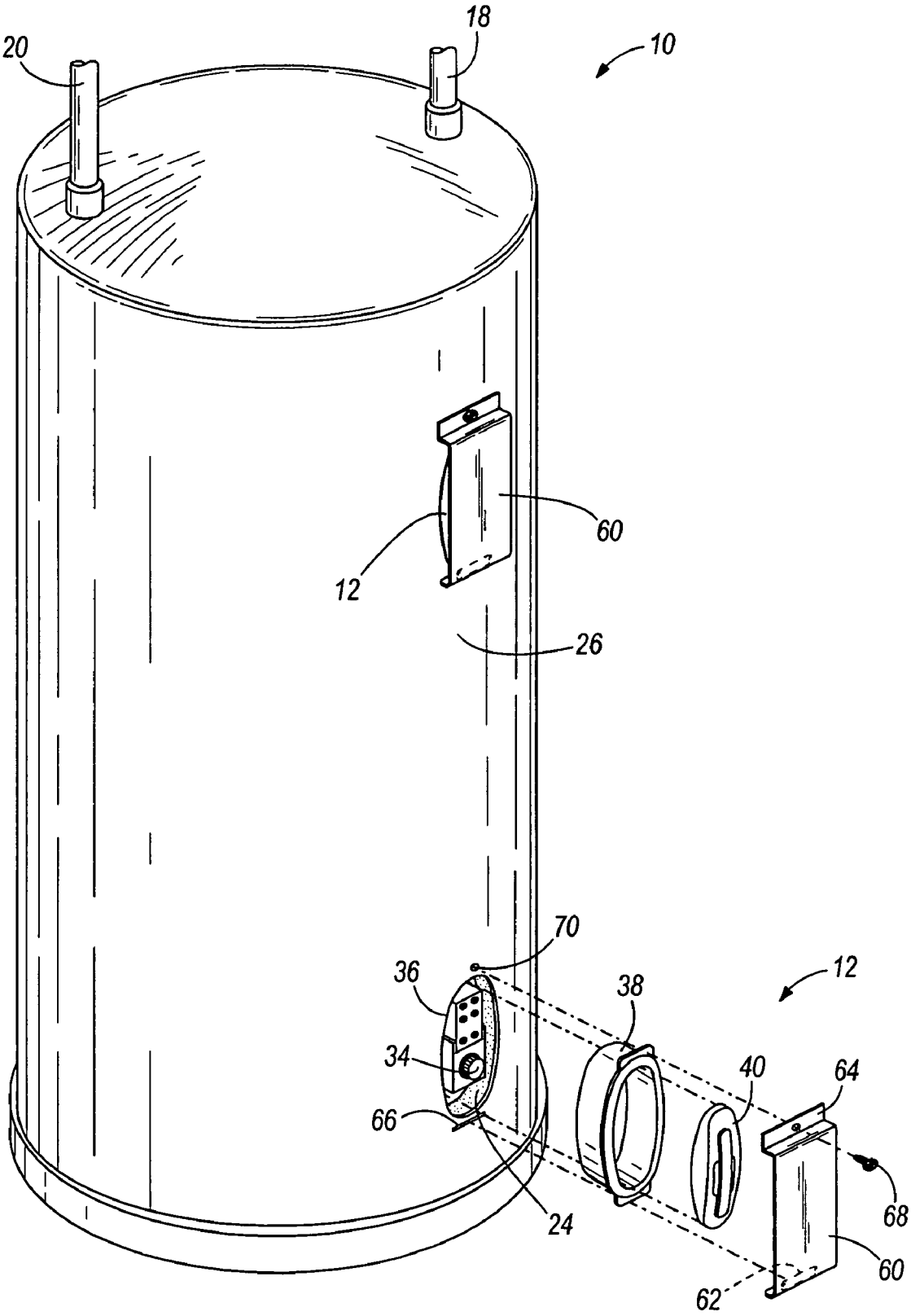
FIG. 2 is a partially exploded perspective view of the water heater and dam assembly of FIG. 1.
Figure 3:
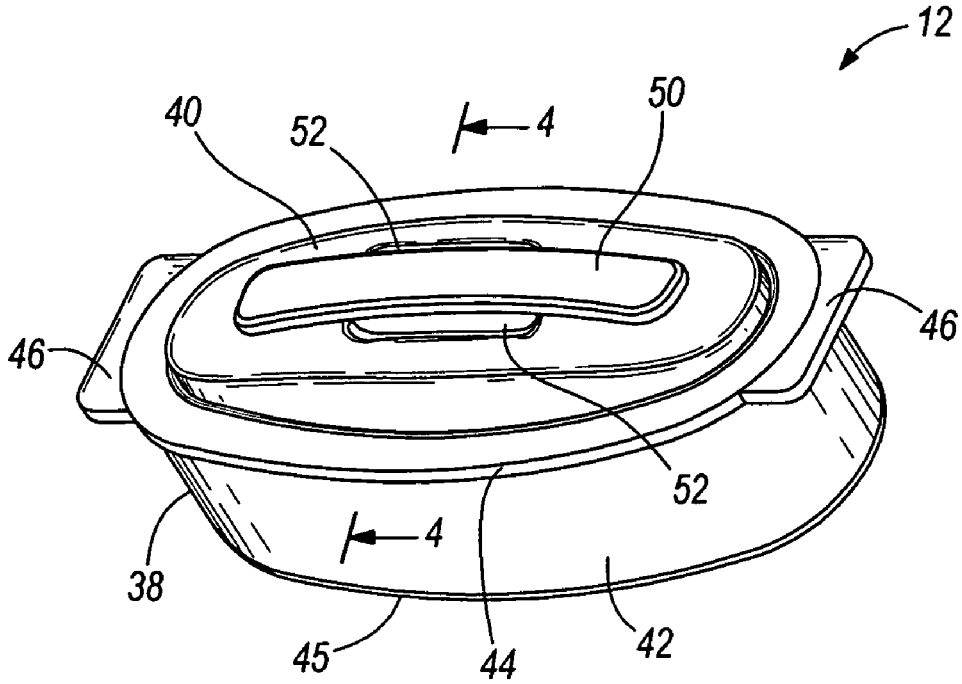
FIG. 3 is a perspective view of the dam assembly of FIG. 1.
Figure 4:
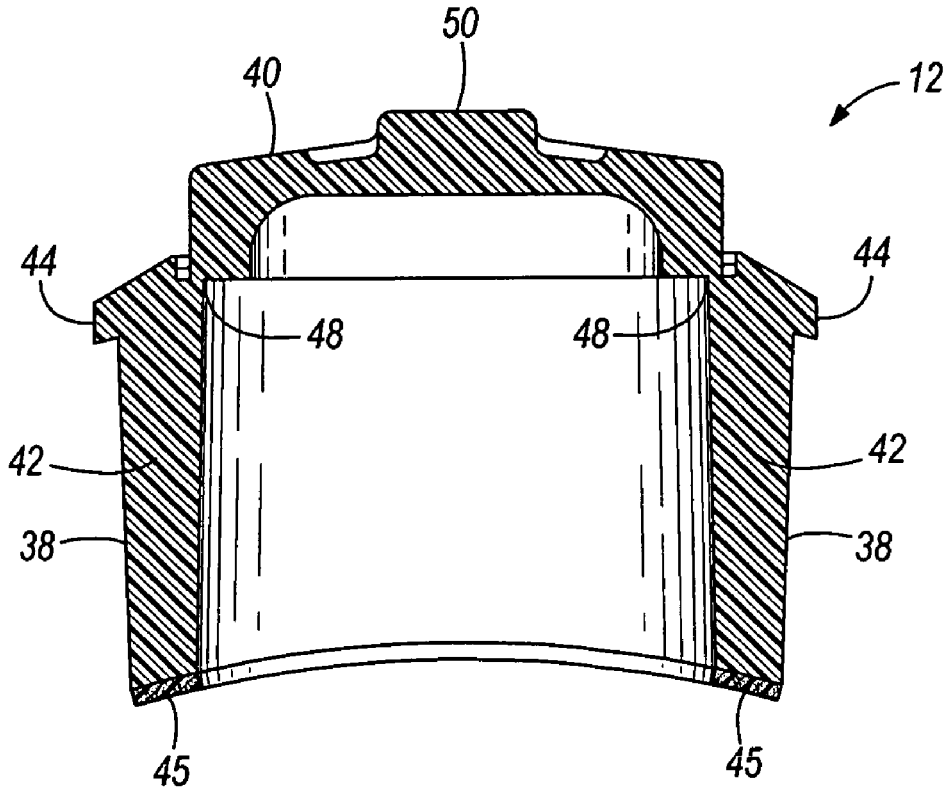
FIG. 4 is a cross-sectional view of the dam assembly of FIG. 1 taken along line 4-4 in FIG. 3.

A lid 60 is installed over the dam assembly 12 to further increase the seal between the wall 42 and the jacket 26 and between the seal 45 and the tank 14 during injection of the insulation material 24. The lid 60 improves the seal by engaging the handle 50 of the inner portion 40 and pressing and holding the inner portion 40 within the outer portion 38. The lid 60 also helps prevent unwanted access to the dam assembly 12 without tools by substantially covering the dam assembly 12. As best shown in FIGS. 1 and 2, the lid 60 is a substantially flat plate with a locking tab 62 and a fastening tab 64. The lid 60 is positioned over the dam assembly 12 after the dam assembly 12 is installed in the aperture 36. The locking tab 62 is inserted into a locking aperture 66 adjacent the aperture 36, and a fastener 68 is inserted through the fastening tab 64 and into an aperture 70, also adjacent the aperture 36. In the illustrated embodiment, a single fastener 68 is used, and is a screw. In some embodiments, multiple fasteners of various forms can be used to connect the lid 60 to the jacket 26, or the lid 60 can include locking or sliding tabs such that no fasteners are required to connect the lid 60 to the jacket 26. The lid 60 is rigidly connected to the jacket 26 and substantially covers the dam assembly 12 when the locking tab 62 is engaging the locking aperture 66 and the fastener 68 is engaging the aperture 70. The lid 60 can be removed from the jacket 26 by removing the fastener 68.

One of the tabs 46 on the outer portion 38 extends to the locking aperture 66 when the dam assembly 12 is installed in the aperture 36. The lid 60 compresses the tab 46 when the locking tab 62 of the lid 60 engages the locking aperture 66 and the lid 60 is installed as described above. The compressed tab 46 forms a seal between the lid 60 and the jacket 26 adjacent the locking aperture 66 to help prevent injected insulation material 24 from leaking through the locking aperture 66. The outer portion 38 includes tabs 46 at opposite ends so that the dam assembly 12 cannot be inserted in an incorrect orientation in the aperture 36.

What is claimed is:

1. A dam assembly to protect a component mounted on a water heater tank wall while insulating foam is injected between the tank and a jacket surrounding the tank, the dam assembly comprising:

an outer portion;

an inner portion; and a frangible web connecting the inner and outer portions, the web having a strength sufficient to withstand force applied to the inner portion to press the dam assembly into an aperture in the jacket such that the outer portion surrounds the component between the tank and the jacket, and the web breaking under the application of a pre-determined force on the inner portion, allowing the inner portion to be at least partially pushed inside the outer portion to enclose the component within the dam assembly.

2. The dam assembly of claim 1, wherein the outer portion includes an endless wall that defines a central cavity in which the component is located.

3. The dam assembly of claim 2, wherein the cavity is oval-shaped.

4. The dam assembly of claim 2, wherein the inner portion is shaped to fit within the cavity.

5. The dam assembly of claim 2, wherein the wall is oval shaped.

6. The dam assembly of claim 1, wherein the outer portion includes a sealing member that sealingly engages the tank around the component.

7. The dam assembly of claim 6, wherein the sealing member is constructed of open cell polyurethane foam.

8. The dam assembly of claim 6, wherein electrical wires extend between the sealing member and the tank.

9. The dam assembly of claim 1, wherein the outer portion is tapered to wedgingly engage the jacket when the outer portion is substantially completely inserted into the aperture in the jacket.

10. The dam assembly of claim 1, wherein the inner portion, the outer portion, and the frangible web are constructed of expanded polystyrene.

11. The dam assembly of claim 1, wherein the inner portion, the outer portion, and the frangible web are molded as a single piece.

12. The dam assembly of claim 1, wherein the inner portion includes an integral handle to facilitate removal of the inner portion from the dam assembly.

13. The dam assembly of claim 1, wherein the inner portion forms an interference fit with the outer portion when pushed into the outer portion to improve a sealing engagement between the outer portion and the jacket.

14. The dam assembly of claim 1, wherein the dam assembly is configured to nest with respect to other dam assemblies.

15. A water heater comprising:

a tank;

means for heating water in the tank;

a component mounted on the tank;

a jacket substantially surrounding the tank and including an aperture providing access to the component;

foam insulation between the tank and the jacket;

a dam assembly including an inner portion, and outer portion, and a frangible web connecting the inner and outer portions;

the web having a strength sufficient to withstand force applied to the inner portion to press the dam assembly into the aperture in the jacket such that the outer portion surrounds the component between the tank and the jacket, and the web breaking under the application of a pre-determined force on the inner portion, allowing the inner portion to be at least partially pushed inside the outer portion to enclose the component within the dam assembly.

16. A method of manufacturing a water heater, the method comprising:

providing a water heater including:

a water tank;

means for heating water in the water tank;

a component mounted on the tank; and a jacket substantially surrounding the tank and including an aperture providing access to the component;

providing a dam assembly including:

an inner portion;

an outer portion; and a frangible web connecting the inner and outer portions;

pressing on the inner portion to push the dam assembly into the aperture such that the outer portion surrounds the component between the tank and the jacket;

thereafter pressing the inner portion of the dam assembly with sufficient force to break the web and at least partially push the inner portion into the outer portion to enclose the component within the dam assembly; and injecting foam insulation between the water tank and the jacket and outside the dam assembly.

17. The method of claim 16, wherein the outer portion includes an endless wall that defines a central cavity in which the component is located.

18. The method of claim 17, wherein the cavity is oval-shaped.

19. The method of claim 17, wherein the inner portion is shaped to fit within the cavity.

20. The method of claim 17, wherein the wall is oval shaped.

21. The method of claim 17, wherein the outer portion includes a sealing member that sealingly engages the tank around the component.

22. The method claim 21, wherein the sealing member is constructed of open cell polyurethane foam.

23. The method of claim 16, wherein the outer portion is tapered to wedgingly and sealingly engage the jacket when the outer portion is inserted into the aperture in the jacket.

24. The method of claim 16, wherein the inner portion, the outer portion, and the frangible web are constructed of expanded polystyrene.

25. The method of claim 16, wherein the inner portion, the outer portion, and the frangible web are molded as a single piece.

26. The method of claim 16, wherein the inner portion includes an integral handle to facilitate removal of the inner portion from the dam assembly.

27. The method of claim 16, wherein the inner portion forms an interference fit with the outer portion when pushed into the outer portion to improve a sealing engagement between the outer portion and the jacket.

28. The method of claim 16, wherein the dam assembly is configured to nest with respect to other dam assemblies.

29. The method of claim 16, further comprising providing a lid configured to engage a slot in the jacket.

30. The method of claim 29, further comprising engaging the lid and the slot such that the lid helps retain the inner portion inside the outer portion.

31. The method of claim 29, wherein the outer portion of the dam assembly includes a foam tab configured to form a seal between the lid and the jacket such that the injected foam insulation does not leak from the slot in the jacket.

32. The method of claim 29, further comprising fastening the lid to the jacket with a single fastener.

* * * * *